United States Patent [19]

Malm

[11] 3,968,749

[45] July 13, 1976

[54] LAND MINE

[75] Inventor: Karl Olof Bertil Malm, Stockholm, Sweden

[73] Assignee: AB Bofors, Bofors, Sweden

[22] Filed: May 16, 1974

[21] Appl. No.: 470,508

[30] Foreign Application Priority Data

May 22, 1973 Sweden ..... 7307161

[52] U.S. Cl. ..... 102/8

[51] Int. Cl.[2] ..... F42B 23/26

[58] Field of Search ..... 102/8

[56] References Cited

UNITED STATES PATENTS 2,857,842 10/1958 Malm ..... 102/8

*Primary Examiner*—Charles T. Jordan

*Attorney, Agent, or Firm*—Elliott I. Pollock

[57] ABSTRACT

A land mine is provided with a pair of nested bowl shaped parts having their respective contacting surfaces arranged for tangential displacement relative to one another, and an actuating device provided in the mine is selectively responsive to such tangential displacement for activating the percussion mechanism in the mine. The actuating device includes a member located in a space provided between the contacting surfaces of the nested parts, and a locking device operates in response to the presence of a predetermined external force to lock such member to one of said parts to cause said member to activate the percussion mechanism upon occurrence of the tangential displacement between the parts. The locking mechanism is responsive to the absence of said predetermined external force for unlocking said member from said part to prevent activation of the percussion mechanism upon occurrence of said tangential displacement between the parts.

6 Claims, 1 Drawing Figure

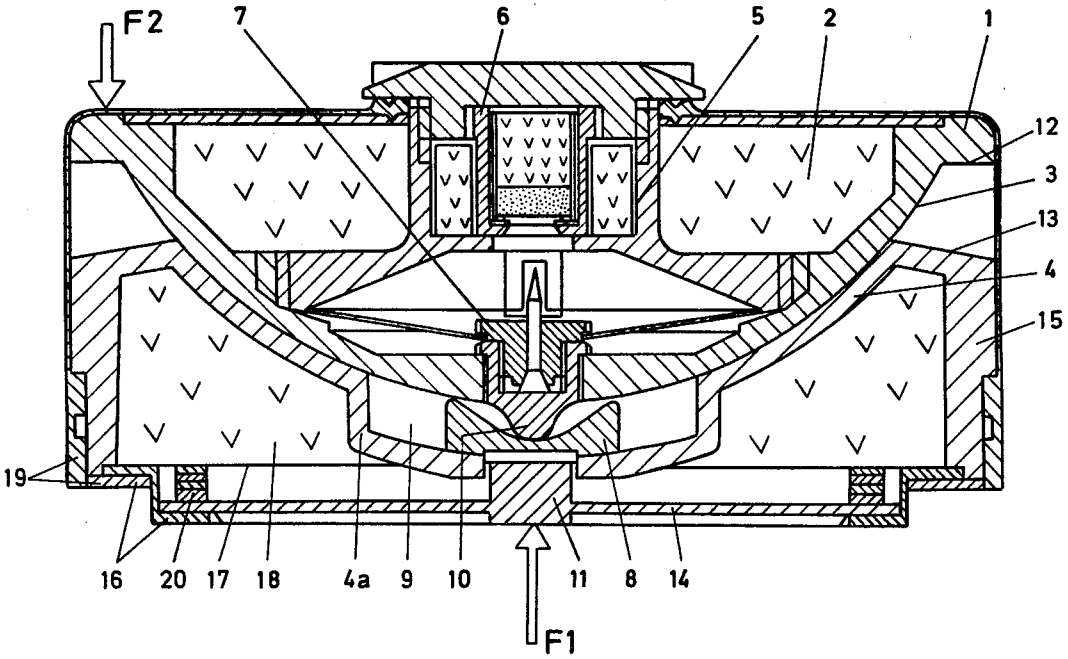
1
2
5
6
7
F2
12
3
13
4
15
14
8
11
F1
10
9
4a
18
17
20
16
19

LAND MINE

The present invention relates to a land mine comprising two nested parts arranged so that they are tangentially displaceable in relation to each other, one part having a spherical contact surface which is supported in and slidably displaceable along a complementarily shaped and sized bowl-shaped contact surface of the second part. The term "tangential displacement", as employed herein and in the appended claims, is intended to refer to an angular sliding movement of parts relative to one another while the spherical contact surface of said one part remains supported in said bowl-shaped contact surface of the second part. The land mine in question also comprises a percussion mechanism and devices which upon movement of the parts in relation to each other in the form of such a tangential displacement of the parts at their respective contact surfaces, are intended to activate the percussion mechanism, which then in turn initiates a detonator in the land mine. Said devices comprise a member which is placed in a space extending in the direction of said tangential displacement and located between the contact surfaces.

A land mine with such initiating devices for all-round initiation is previously known (see the Swedish Pat. No. 171,542) and the present invention relates to a further development of such mines, for which there is a pronounced desire, whereby the mines can be dropped, e.g. from aircraft. When dropping a mine such as the one in question, shocks can occur that cause the tangential displacement of the parts and thereby an undesired initiation of the mine.

The present invention is primarily intended to solve the above-mentioned problem, and involves the provision of a specific and reliably functioning shock protection device which moreover consists of few and non-critical parts.

The feature that can mainly be considered to be characteristic of a land mine according to the invention is that a member, forming a portion of the device used to activate the percussion mechanism, is arranged to be selectively locked in position in relation to the second part so that, upon occurrence of a tangential displacement of the parts at their contact surfaces, the member causes the activation of the percussion mechanism, and the member is also adapted to assume an unlocked position in relation to the second part, in which, upon occurrence of said tangential displacement, the member merely follows the one part to an extent determined by the space in which the member is located, for the purpose of preventing said activation.

An embodiment proposed at present of a land mine that has the characteristics significant for the invention will be described in the following, with reference to the attached drawing, in which the FIGURE in a vertical view and in cross section shows the new land mine.

In the FIGURE, a container that forms the one part of the mine has been designated 1. The container, which has the form of a cap, supports a bursting charge 2, and has a spherical surface 3 which is supported in a second part 4 of the mine, the part 4 having a bowl-shaped contact surface complementary in shape to the spherical surface 3. The container 1 is provided with a central fuze 5, in which a detonator 6, which is known in itself, is screwed in, in a known way. The detonator 6 has a bursting charge and an initiating charge which is initiated by a percussion mechanism 7, which is also known, which in the present case comprises a striker point with an unstable central position, fastened in a membrane.

The mine also comprises devices which are intended to initiate the percussion mechanism 7, which in the present case involves that the membrane is to be actuated past its unstable central position, from where the membrane can give the striker point the speed required. Said devices comprise a member 8 placed in a space 9 located between the central sections of the contact surfaces, and formed by the second part 4 being made with a depressed section 4*a* at said central sections. The member 8 has a circular horizontal cross-section and is made with a bowl-shaped depressed section, against the surface of which rests a spherical contact surface 10 of the percussion device 7, in the unactivated position of the mine. The bowl-shaped depressed section in member 8 and the contact surface 10 are made in such a way in relation to each other that at the initiation procedure for the mine the member 8 gives the percussion mechanism 7 a movement directed upwards when a relative tangential displacement of the parts 1,4 takes place at their contact surfaces due to the application of an external force $F_2$.

The member 8 also coacts with a locking mechanism in the form of a lug 11 which engages with the member 8 via a recess in the depressed section 4*a* of the part 4 when an external force $F_1$ acts upon the underside of the part 4, but from which lug 11 the member 8 is separated when said force $F_1$ is not present. In the latter case, the member 8 is free to carry out transversal movements in the space 9. The shape of the member 8 and the coefficient of friction are chosen in such a way that the member 8 in the non-engaged position can follow any tangential movements that might occur in the part 1, and in this case the percussion mechanism 7 will remain unactuated. The extent of the space 9 in the tangential direction is so chosen that the maximum transversal movement of the member 8 corresponds to the total tangential movement between the parts 1 and 4, which is determined by stopping surfaces 12 and 13, respectively, located on the parts 1 and 4.

In order to obtain the engaging movement for the lug 11 in the member 8, the under side of the part 4, or the bottom of the mine, is made in the form of a spring membrane 14, which has its outer edge fastened in a flange 15, directed downwards, belonging to the part 4, which together with said membrane 14 forms the support for the mine against the ground. The membrane is fastened by means of a ring 16, appropriately made of rubber or the like, which has an angular cross section and which rests against an under surface of the flange 15 and against the surface 17 of a further bursting charge 18 located in the part 4. Said angular ring 16, in turn, is secured by means of a further ring 19 with an angular cross section, which can be screwed to the under side of the flange 15. The membrane 14 is pressed against the ring 16 by means of a ring 20 made of elastic material, which is inserted between said surface 17 on the bursting charge 18 and the ring 16.

The various parts of the mine are partly or entirely enclosed with rubber sheathing or the like, in a way which is known in itself.

From the above, it will be obvious that, notwithstanding the simple construction, a land mine is obtained which is initiated by an initiating force $F_2$ only when it is subjected simultaneously to an external force $F_1$ acting on the bottom of the mine in its said position on or in the ground.

The invention is not limited to the embodiment shown as an example, but can be subject to modifications within the scope of the following claims.

I claim:

1. A land mine comprising two relatively movable parts, one of said parts having a spherical contact surface which is supported in and slidably engages a complementary bowl-shaped contact surface in the second part, said parts being adapted to be tangentially displaced relative to one another at their respective contact surfaces upon application of an external force to one of said parts, a percussion mechanism, an actuating device selectively responsive to said tangential displacement of said parts at their respective contact surfaces for activating said percussion mechanism, said actuating device comprising a member located in a space between said contact surfaces, and locking means adjacent said member responsive to the presence of a further external force for selectively locking said member in fixed position relative to said second part so that, upon occurrence of said tangential displacement of said parts at their respective contact surfaces, relative movement occurs between said member and said first part to cause said member to activate said percussion mechanism, said locking means being responsive to the absence of said further external force for unlocking said member from said second part to permit said member to follow the movement of said first part within said space upon occurrence of said tangential displacement thereby to prevent the activation of said percussion mechanism.

2. The land mine of claim 1 in which said two parts are provided with stopping surfaces which limit the extent of total tangential displacement between said parts, said space between said contact surfaces being dimensioned to permit said member to follow said one part within said total displacement when said member is unlocked from said second part.

3. The land mine of claim 1 wherein said locking means includes resilient means operative to urge said locking means toward its unlocked position, said locking means being responsive to said further external force applied to the underside of said land mine for overcoming the force of said resilient means and for moving said locking means to a position wherein said member is locked to said second part.

4. The land mine according to claim 3 wherein said resilient means comprises a flexible membrane forming the underside of said mine, said membrane being fastened to said second part at its outer edges, said locking means comprising a lug which is fastened to the center of said membrane for inward movement toward a recess in said member.

5. A land mine according to claim 4 wherein said resilient means includes a ring of elastic material in engagement with said membrane adjacent its outer edges.

6. A land mine according to claim 1 wherein said member has a circular cross section, one end of said member being provided with a bowl-shaped depression which faces said percussion mechanism, and said percussion mechanism including a spherical contact surface in engagement with said bowl-shaped depression.

* * * * *